US005938198A

United States Patent [19]

Kostecki

[11] Patent Number: 5,938,198

[45] Date of Patent: Aug. 17, 1999

[54] SLIDABLE CARD DEVICE FOR ALTERNATING PLAYER POSITIONS DURING A GAME

[76] Inventor: Paul T. Kostecki, 17 Stillwater Rd., South Deerfield, Mass. 01373

[21] Appl. No.: 08/964,688

[22] Filed: Nov. 5, 1997

[51] Int. Cl.[6] ..... A63K 71/02

[52] U.S. Cl. ..... 273/148 R; 283/65

[58] Field of Search ..... 273/148 R, 288, 273/277; 473/451; 283/65, 117; 116/222, 225

[56] References Cited

U.S. PATENT DOCUMENTS

| | | | |
|---|---|---|---|
| 2,145,664 | 1/1939 | Ristow | 116/222 |
| 2,163,978 | 6/1939 | Ivanek | 116/222 |
| 3,113,779 | 12/1963 | Guenther | 283/65 |
| 3,269,752 | 8/1966 | Lindaman | 283/65 |
| 5,582,128 | 12/1996 | Wollan et al. | 116/225 |
| 5,664,780 | 9/1997 | Bricker | 273/288 X |

*Primary Examiner*—Raleigh W. Chlu

*Attorney, Agent, or Firm*—Donald S. Holland, Esq.; Holland & Bonzagni, P.C.

[57] ABSTRACT

A slidable card device is disclosed for assisting coaches, and assistant coaches, in alternating player positions during a T-Ball League or Little League ball game. In the preferred embodiment, the invention includes a thin, generally rectangular housing or sheath having a front, a back, two closed sides, and two opened ends. The front of the sheath includes a roster box for the coach to handwrite the names of his/her players in column format, as the players show up. Next to the player names is a viewing window which exposes an insert card inside the sheath. This insert card has a series of preprinted matrices that match the number of possible player positions for a ball game. Once the number of players has been determined, the coach selects which matrix appears in the window. Each matrix includes a series of columns which lists the possible player positions, for that game, in various orders. The invention is used in the following manner to assign the player positions during ball game: the insert card is withdrawn incrementally, prior to each inning, to expose a different fielding position (through the viewing window) next to each of the player names handwritten on the roster.

4 Claims, 4 Drawing Sheets

126

128

| 14 | 14 | 14 | 14 | 14 | 14 | 13 | 13 | 13 | 13 | 13 | 13 |
|---|---|---|---|---|---|---|---|---|---|---|---|
| 1 | 2 | 3 | 4 | 5 | 6 | 1 | 2 | 3 | 4 | 5 | 6 |
| **Fourteen Player Table** | | | | | | **Thirteen PLayer Table** | | | | | |
| 1B | LCF | C | RCF | P | CF | 1B | LCF | C | RCF | P | CF |
| 2B | RCF | 1B | LCF | C | RCF | 2B | RCF | 1B | LCF | C | RCF |
| 3B | LCF | 2B | CF | 1B | RCF | 3B | LCF | 2B | CF | 1B | RCF |
| SS | CF | 3B | RCF | 2B | LCF | SS | CF | 3B | RCF | 2B | LCF |
| RF | P | SS | LCF | 3B | CF | RF | P | SS | LCF | 3B | CF |
| CF | C | RCF | P | SS | LCF | CF | C | RCF | P | SS | LCF |
| LF | 1B | CF | C | RF | P | LF | 1B | CF | C | RF | P |
| RCF | 2B | LF | 1B | CF | C | RCF | 2B | LF | 1B | CF | C |
| LCF | 3B | RCF | 2B | LF | 1B | LCF | 3B | RCF | 2B | LF | 1B |
| RCF | SS | RF | 3B | LCF | 2B | RCF | SS | RF | 3B | LCF | 2B |
| LCF | RF | CF | SS | RCF | 3B | LCF | RF | LCF | SS | RCF | 3B |
| C | RCF | P | CF | LCF | LF | P | LF | LCF | RF | RCF | SS |
| CF | LF | LCF | RF | RCF | SS | C | RCF | P | LF | LCF | RF |
| P | CF | LCF | LF | CF | RF | | | | | | |

130

| 12 | 12 | 12 | 12 | 12 | 12 | 11 | 11 | 11 | 11 | 11 | 11 |
|---|---|---|---|---|---|---|---|---|---|---|---|
| 1 | 2 | 3 | 4 | 5 | 6 | 1 | 2 | 3 | 4 | 5 | 6 |
| **Twelve Player Table** | | | | | | **Eleven PLayer Table** | | | | | |
| 1B | CF | C | LF | P | RCF | 1B | RCF | C | RF | P | SS |
| 2B | LF | 1B | LCF | C | CF | 2B | CF | 1B | RCF | C | RF |
| 3B | RCF | 2B | CF | 1B | RF | 3B | LCF | 2B | CF | 1B | RCF |
| SS | LCF | 3B | RCF | 2B | CF | SS | LF | 3B | LCF | 2B | CF |
| RF | P | SS | LF | 3B | LCF | RF | P | SS | LF | 3B | LCF |
| CF | C | RF | P | SS | LF | RCF | C | RF | P | SS | LF |
| CF | 1B | LCF | C | RF | P | CF | 1B | RCF | C | RF | P |
| LF | 2B | RCF | 1B | CF | C | LCF | 2B | CF | 1B | RCF | C |
| RCF | 3B | CF | 2B | LCF | 1B | LF | 3B | LCF | 2B | CF | 1B |
| LCF | SS | CF | 3B | RCF | 2B | P | SS | LF | 3B | LCF | 2B |
| P | RF | LF | SS | CF | 3B | C | RF | P | SS | LF | 3B |
| C | CF | P | RF | LF | SS | | | | | | |

132

108

| 10 | 10 | 10 | 10 | 10 | 10 | 9 | 9 | 9 | 9 | 9 | 9 |
|---|---|---|---|---|---|---|---|---|---|---|---|
| 1 | 2 | 3 | 4 | 5 | 6 | 1 | 2 | 3 | 4 | 5 | 6 |
| **Ten Player Table** | | | | | | **Nine PLayer Table** | | | | | |
| 1B | LCF | C | SS | P | 3B | 1B | SS | C | 3B | P | 2B |
| 2B | RCF | 1B | RF | C | SS | 2B | RF | 1B | SS | C | 3B |
| 3B | LCF | 2B | RCF | 1B | RF | 3B | CF | 2B | RF | 1B | SS |
| SS | LF | 3B | LCF | 2B | RCF | SS | LF | 3B | CF | 2B | RF |
| RF | P | SS | LF | 3B | LCF | RF | P | SS | LF | 3B | CF |
| RCF | C | RF | P | SS | LF | CF | C | RF | P | SS | LF |
| LCF | 1B | RCF | C | RF | P | LF | 1B | CF | C | RF | P |
| LF | 2B | LCF | 1B | RCF | C | P | 2B | LF | 1B | CF | C |
| P | 3B | LF | 2B | LCF | 1B | C | 3B | P | 2B | LF | 1B |
| C | SS | P | 3B | LF | 2B | | | | | | |

136

134

*FIG. 3*

SLIDABLE CARD DEVICE FOR ALTERNATING PLAYER POSITIONS DURING A GAME

BACKGROUND OF THE INVENTION

This invention is a hand-held slidable card device that assists Little League and T-Ball league coaches (and assistant coaches) in the placement of players on the playing field for a ball game. It is nicknamed the Little Line-up Card™ or LLC™ game card; and its usage has been recommended by T-Ball USA, the national organization that governs T-Ball leagues.

T-Ball is the baseball equivalent for younger children, typically five to eight years of age. The basic philosophy for most T-Ball leagues is to have large teams (nine to fourteen players each), play every player in the field each inning, and try to give each player a chance to play each position or, at least, equitable playing time between the infield and outfield. This causes logistical problems for coaches because they may have more players on a team than there are normal positions (nine); and, each game is no more than six innings. A coach can overcome the limited positions issue by creating additional positions in the outfield such as left centerfield or right centerfield. The trickier problems are: keeping track of who has played where from inning to inning; and, trying to ensure that little Johnny/Jenny does not wind up playing right field three innings in a row or does not get a chance to play the infield during the entire game.

A coach cannot develop positional line-ups the night before the game or even just prior to the game because you are never sure how many or which players will show up. The only choice the coaches have is to send players out to different positions, inning by inning and with no set pattern, and to respond by the "seat of their pants" to kids saying where they played the previous innings. This becomes unfair because the kids who speak up get to play different positions, but those kids who are shy may wind up playing the same positions. The coaches can try to develop positional patterns on paper during the game, but this is extremely difficult under game conditions.

Although not every child can play every position in every game, the LLC™ card device ensures the best mathematical distribution of players for any given number of players. If the coach uses a new LLC™ card for every game, he/she can basically randomize the roster line-ups, thereby maximizing the possibility that each player will get to experience playing every position during the course of the season.

The coach can also keep track of where each child has played by keeping each game card as a record.

SUMMARY OF THE INVENTION

This invention is a hand-held slidable card device that fits within a T-Ball coach's shirt pocket when not in use. The device is intended to allow the coach to make decisions easily and to ensure that players are distributed amongst positions during a ball game. It also maximizes the players' chances of playing all positions equally (time-wise) during the course of the season.

In the preferred embodiment, this invention comprises a thin, flat, rectangular sheath or housing that is open at both ends. Inside the housing is an insert card. It can be withdrawn incrementally from the sheath to expose different preprinted columns in two viewing windows. One of the columns is next to the player roster, written by the coach on the outside of the sheath. Each card column lists all the positions fielded by the team that day. These columns all vary in the order of positions listed. By shifting the card, different columns show up next to the player names (on the roster) to help the coach assign new positions.

BRIEF DESCRIPTION OF THE DRAWINGS

FIG. 3 is a foldable insert card with different numbered player tables;

DETAILED DESCRIPTION OF THE PREFERRED EMBODIMENT

Figure 1:
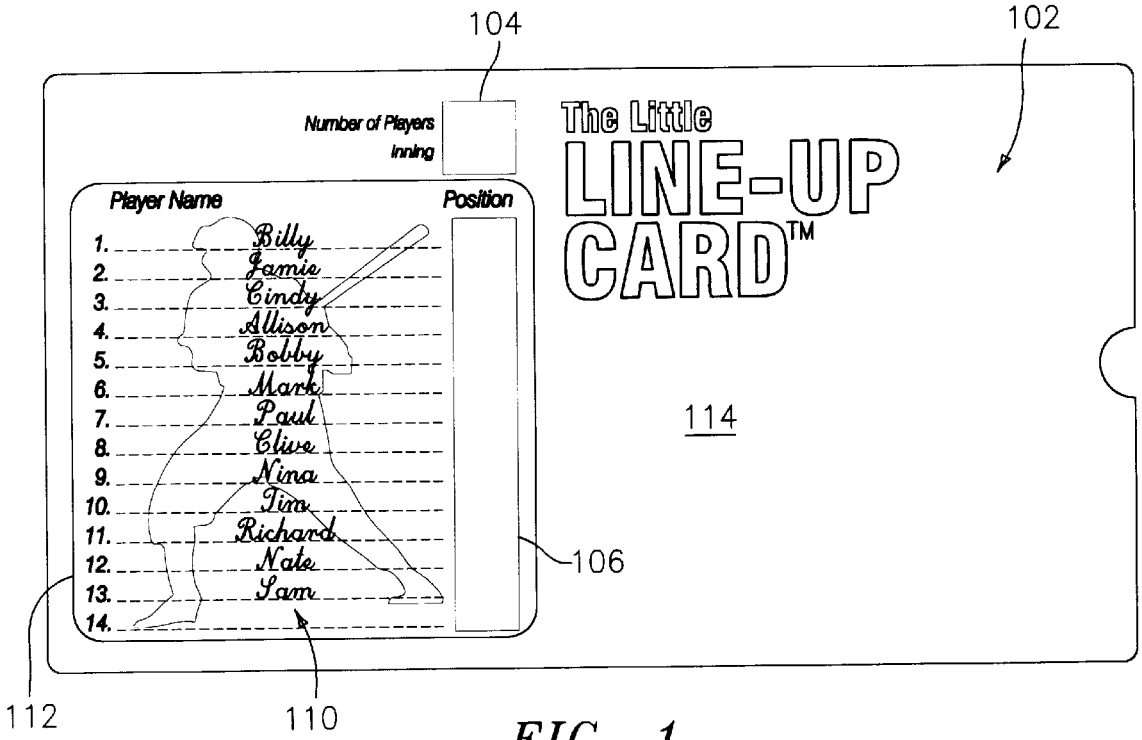
FIG. 1 is a plan view of the front of a sheath for a preferred Little Line-up Card™ (LLC™), constructed in accordance with the present invention.

Referring to FIGS. 1–5 in detail, Applicant's preferred Little Line-up Card™ (LLC™) is shown and generally designated by the reference numeral 100. It is marketed by J & A Enterprises of Amherst, Mass.

The illustrated LLC™ device 100 comprises a flat rectangular sheath or housing 102 with two viewing windows 104, 106; and a removable, slidable, insert card 108 that is sheathed within the housing. A user slides the card partially out, at sequential amounts, to expose preprinted columns through the windows. These columns reveal the new positions each inning of player names handwritten on the sheath.

In the preferred embodiment, LLC™ housing 102 is approximately 17.7×9.5 cm and constructed of card stock paper. The housing 102 contains the two viewing windows 104, 106 which allow for the display of information from the removable, sliding insert 108. One smaller viewing window 104, approximately 1.1 cm square, allows for the display of the number of players and the innings. It is located directly above the other viewing window 106. The second window 106 or "position window" is much larger, approximately 6.6×1.1 cm. The position window 106 allows for the display of playing positions and is located next to the individual player names on a roster list 110 handwritten by the coach. This placement allows one position to correspond to one player.

LLC™ housing 102 contains a roster listing box 112 on the LLC™'s front 114. A score-keeper box 116, note box 118, and instruction section 120, are located on the LLC™'s back 122. Player names and positions have been shown in cursor type at 110, 124 to represent that they have been "filled in" by the coach.

Figure 2:
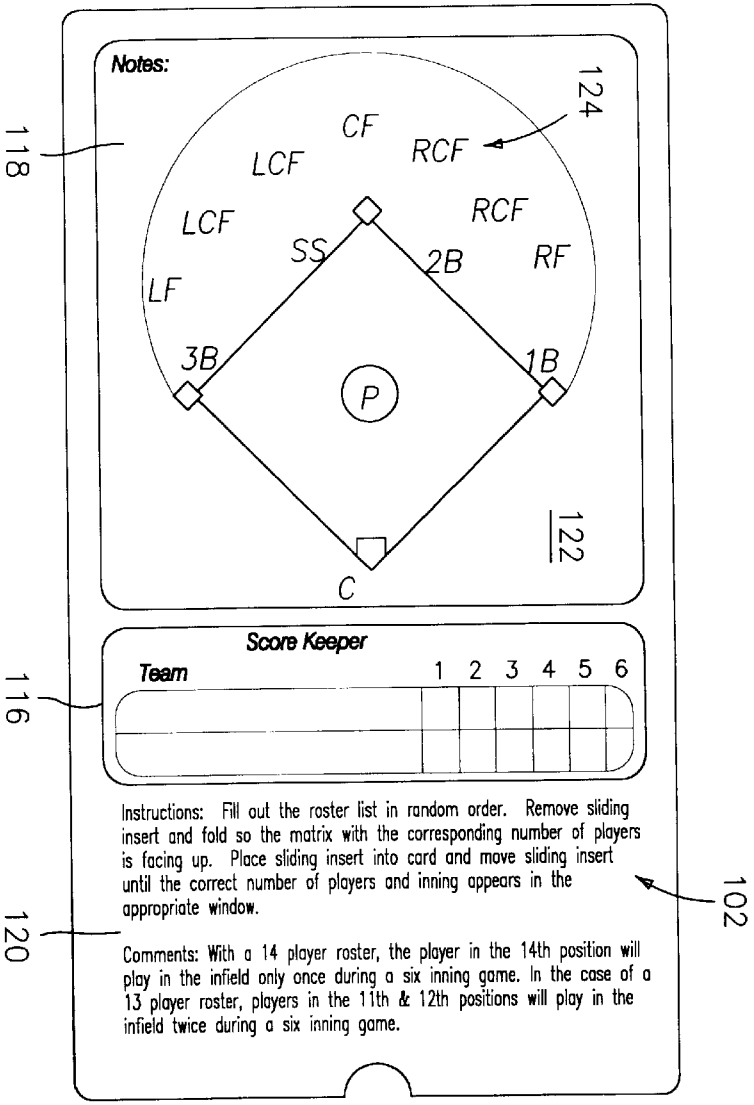
FIG. 2 is a plan view of the back of the FIG. 1 sheath.

The removable sliding insert 108 is approximately 18.4×27.7 cm when unfolded, 18.4×9.3 cm when folded, and constructed of card stock paper. The sliding insert 108 contains six player tables or matrices 126, 128, 130, 132, 134, 136: for nine, ten, eleven, twelve, thirteen, and fourteen player teams (as shown in FIG. 2).

By following these steps, the LLC™ game card is easy to use:

Fill out the roster list 110 with the names of each player, one name per line;

Determine the total number of players from the roster list;

Remove sliding insert 108, fold it so that the correct number of players matrix (e.g., 126) is facing you, and slide it back into the housing 102 with the roster side 116 up;

Slide insert 108 until the proper number of players and the correct inning appear in top window 104 (see FIG. 4); and Adjust insert each inning.

Game Scenario

Perhaps it would be best to explain the LLC™ usages and advantages by describing the following game scenario, prefaced by some background information.

Coach Pete is a T-Ball coach in South Deerfield, Mass. and coaches one of four town teams. The town teams are in a regional league that includes teams from the towns of Whately, Sunderland and Conway. All in all there are ten teams in the league. Teams range in size from ten to fourteen players. Pete's team has fourteen players. Each team plays ten games over the course of the season. The length of games varies from four to six innings depending on available daylight since games are played in the evening.

The league has decided on a series of rules that ensure that each child plays as much as possible. The rules state that all children play in the field each inning and that they do not play the same position more than once during a game. A batting order is established prior to the game and followed throughout. Teams can only bat through the order once during an inning or until they score five runs, whichever comes first. If five runs are scored before going through the order, they start batting the next inning where they left off, so the coach needs to keep track of the batting order.

Pete knows that with fourteen players he will have to create extra outfield positions, such as left centerfield and right centerfield, and play with two centerfielders to have all the players in the field. With six infield positions and eight outfield positions, some children will not be able to play equally in the infield and outfield during a game.

Pete is faced with a dilemma. How does he distribute players amongst positions during a game and between games in a way that is in keeping with the league rules for equal playing and positional time? The games move along at a rapid pace and Pete has to be able to quickly assign positions at the beginning of each inning. Pete cannot make up field assignments much before game time because he cannot be sure how many and which children will show up for each game. Pete needs a rapid method to assign fielding positions in a logical, consistent manner. He would also like to have a record of where people have played during the course of the season.

Coach Pete uses his Little Line-up Card™ 100 to ensure that players are rotated between positions during the game as much as mathematically possible.

Figure 5:
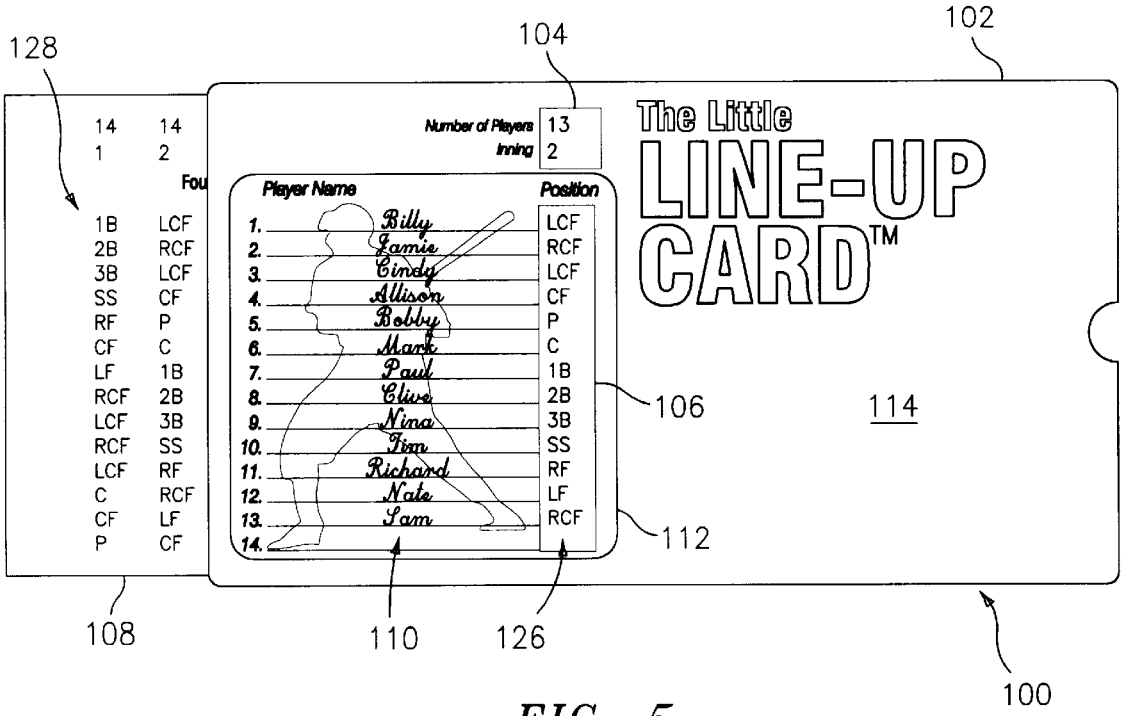
FIG. 5 shows the same LLC™ device being used for the second inning.

As players start showing up for the next game, Pete begins to fill in the players' names on the LLC™ housing 102. He fills in one name per numbered line, sequentially, as they show up. By game time only thirteen of his fourteen players have shown up. They are: Billy, James, Cindy, Allison, Bobby, Mark, Paul, Chris, Nina, Tim, Richard, Nate and Sam (see FIG. 1). Pete takes the LLC™'s sliding insert 108 (shown in FIG. 3) and folds the insert so the Thirteen Player Table 126 is facing up. Pete then slides the insert into the LLC™ housing 102 until 13 appears as the Number of Players and 1 appears as the Inning in top window 104, as shown in FIG. 5. The information in the position window 106 alongside the players' names shows where each child is playing: 1B is for first base; 2B for second base; 3B for third base; SS for shortstop; RF for right field; CF for centerfield; LF for left field; RCF for right centerfield; LCF for left centerfield; P for pitcher; and C for catcher. Using the LLC™ device Pete tells each player where he/she is playing that inning: Billy will play first base; James will play second base; Cindy will play third base; Allison will play shortstop; Bobby will play right field; Mark will play centerfield; Paul will play left field; Chris will play right centerfield; Nina will play left centerfield; Tim will play right centerfield; Richard will play left centerfield; Nate will play pitcher; and Sam will play catcher.

Some players do not know where to stand in the field to play their positions, so Pete turns over the LLC™ housing 102 and uses the schematic of the baseball field in the LLC™'s notes section 118 to show them where different positions are located (FIG. 2). When it is his team's turn to bat, Pete uses the roster list 110 to maintain a batting order. Billy bats first, James bats second, etc. When Pete's team is to take the field for the second inning, Pete slides the LLC™'s insert 108 so that a 2 is showing in the inning window 104 and new fielding positions appear beside the players' names (FIG. 5). Billy now moves to the outfield to play left centerfield, James moves to the infield to play right centerfield, and so on. Pete continues to use the LLC™ 100 device in the third, fourth, fifth and sixth innings (usages not shown) to maintain a batting order and move kids around the field. By the end of the game, Billy has played three positions in the infield (first base, catcher and pitcher) and three positions in the outfield (left centerfield, right centerfield and centerfield), as have James, Cindy, Allison, Bobby, Mark, Paul, Chris, Nina and Tim.

It is mathematically impossible for everybody to play equally between the infield and outfield when playing thirteen players and only six innings. Richard, Nate and Sam wind up playing the infield only twice and the outfield four times during today's game. Pete knows that he can equalize playing time between the infield and outfield for Richard, Nate and Sam by making sure he writes their names in roster slots 1 to 11 in the next game. Pete keeps the LLC™ 100 device from his game as a record and reminder of where people played.

The LLC™ device 100 does provide a user, like coach Pete, with some choice as to where players play in the field. For example, with a team of fourteen players, the players in roster slots 13 and 14 play in the infield only once during a six inning game. The coach can use this information to keep players, who may get hurt playing in the infield, in the outfield for most of the game. With a twelve-player team, only roster slots 1 and 6 allow a child to play the "skilled" positions of pitcher, catcher, and first base. A coach may want to make sure his best players are in those roster positions, though others might be more flexible.

Figure 4:
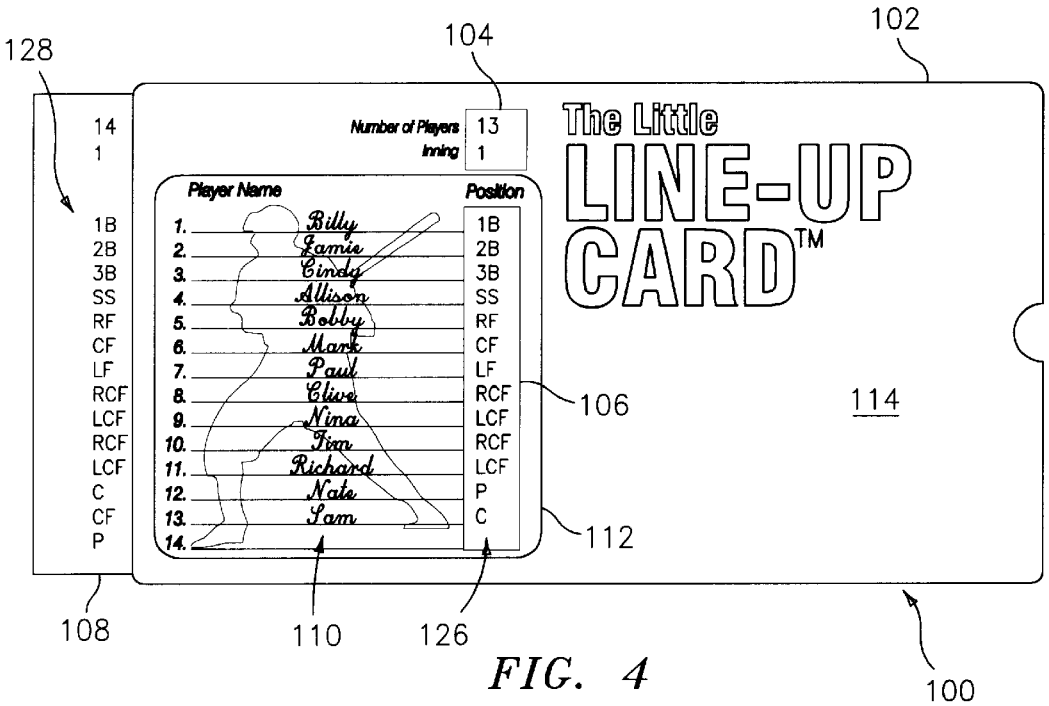
FIG. 4 shows the LLC™ card device of FIGS. 1–3 being used for the first inning of a T-Ball game.
Figure 6:
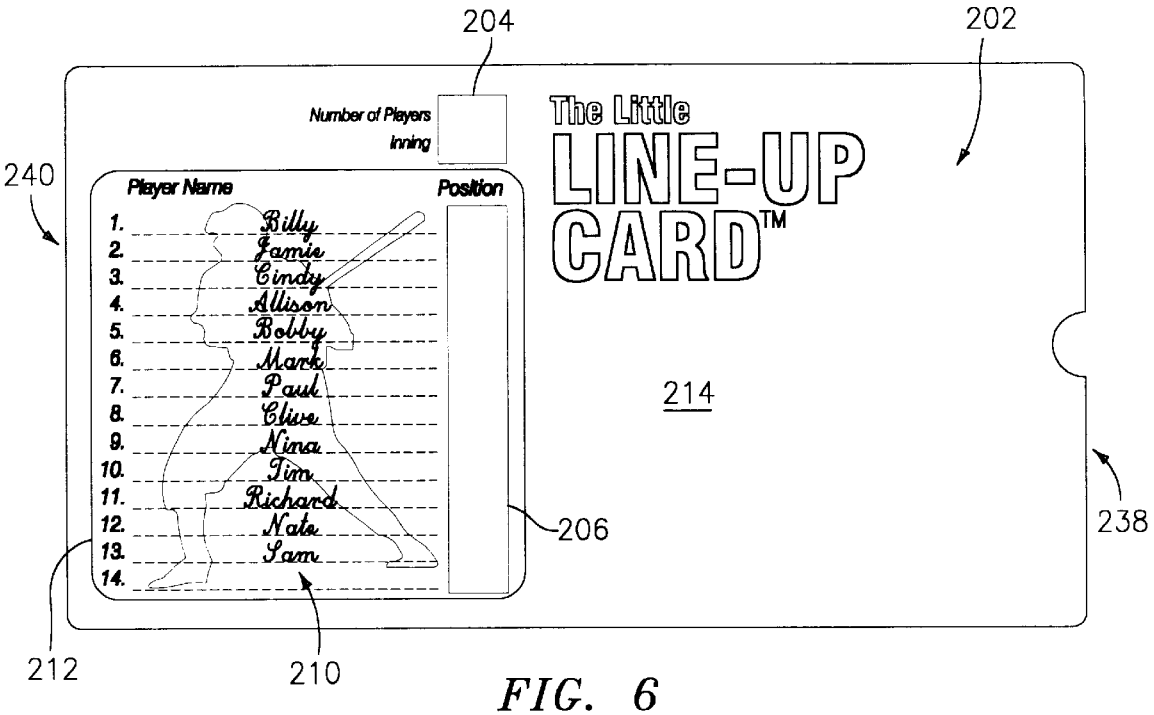
FIG. 6 shows the front of a modified version of the FIG. 1 sheath, in which an end of the sheath is closed.
Figure 7:
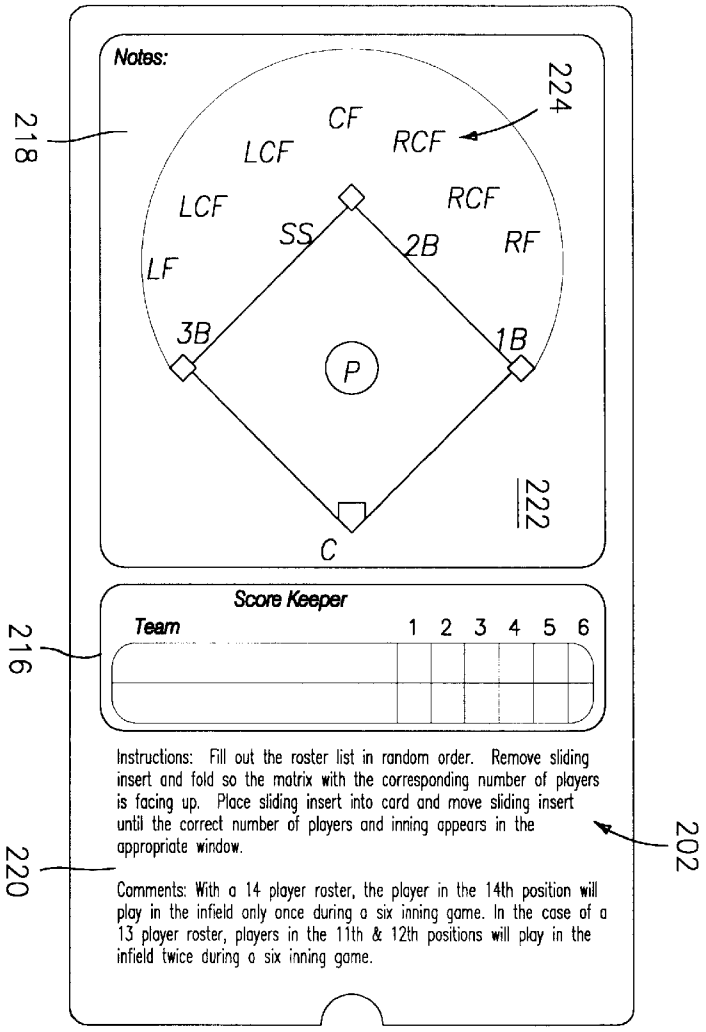
FIG. 7 shows the back of the FIG. 6 sheath.

FIGS. 6–7 illustrate an alternate embodiment 202 of the sheath or housing 102 for the LLC™ device. The elements of housing 202 are virtually identical to those depicted for the housing 102 in FIGS. 1–5, but with an exception. One end of the housing 202 is closed (at 238), while the other end remains open (at 240). In this embodiment, the same insert card 108 from FIGS. 3–5 is used. It is first inserted into housing 202, through open end 240, and then withdrawn from that same open end as the ball game progresses. This differs from the double open-ended housing 102 of FIGS. 1–5, where the card is pushed through the unit, rather than withdrawn.

For easy cross-referencing, the elements in FIGS. 6–7 that are like those depicted in FIGS. 1–5 have been assigned similar reference numerals, but with the "prefix" 200 rather than the "prefix" 100 found in FIGS. 1–5. For example, the roster listing box in FIGS. 6–7 is referred to as 212, while the box in FIGS. 1–5 is referenced as 112.

It should be understood by those skilled in the art that obvious structural modifications can be made without departing from spirit or scope of the invention. For example, the LLC™ housing 102 can be made of metal for greater durability. Accordingly, reference should be made primarily to the accompanying claims, rather than the foregoing specification, to determine the scope of the invention.

Having thus described the invention, what is claimed is:

1. A slidable card device for assisting coaches in alternating player positions during each inning of a ball game, the device comprising:

a. a flat, substantially rectangular sheath with a front, a back, two closed sides, and at least one opened end; and b. means for alternating player positions during each inning of a ball game, said alternating means comprising:

(i) a roster list of player names imprinted in a column format on the front of the sheath;

(ii) at least one viewing window, in the front of the sheath, adjacent the roster list; and (iii) an insert card slidably housed within the sheath, said card having preprinted columns that list every player position to be fielded in the ball game and the columns vary in the order of positions listed, wherein the columns appear, one at a time, through the window, as the card is withdrawn incrementally each inning, to display a different player position each inning aligned with a player's name on the roster list.

2. A slidable card device for assisting coaches in alternating player positions during each inning of a ball game, the device comprising:

a. a flat, substantially rectangular sheath with a front, a back, two closed sides, and two opened ends; and b. means for alternating player positions during each inning of a ball game, said alternating means comprising:

(i) a roster list of player names imprinted in a column format on the front of the sheath;

(ii) at least one viewing window, in the front of the sheath, adjacent the roster list; and (iii) an insert card slidably housed within the sheath, said card having preprinted columns that list every player position to be fielded in the ball game and the columns vary in the order of positions listed, wherein the columns appear, one at a time, through the window, as the card is withdrawn incrementally each inning, to display a different player position each inning aligned with a player's name on the roster list.

3. The card device of claim 1 wherein the columns on the insert card form a plurality of matrices, wherein each matrix differs in the number of player positions listed in each of the columns within said matrix.

4. A selection device comprising:

a. a flat sheath having a front, a back, two closed sides, and two opened ends;

b. a roster list box, on the front of the sheath, for imprinting player names in the form of a column, with one player name per row; and c. means for displaying a different fielding position for each player name during each inning of a ball game, said displaying means comprising:

(i) an insert card slidable housed within the sheath, said card having preprinted columns that list every player position to be fielded in the ball game, and the columns vary in the order of positions listed, said card also having a series of faces with different matrices, wherein each matrix is comprised of preprinted columns that differ in the number of player positions listed in the columns of the remaining matrices; and (ii) at least one viewing window in the front of the sheath adapted in size and shape to align with the columns of a selected matrix, one at a time, as the card is withdrawn from the sheath through one of the opened ends, to display different player positioning each inning adjacent the player names.

* * * * *